US007907040B2

(12) United States Patent
Wada

(10) Patent No.: US 7,907,040 B2
(45) Date of Patent: Mar. 15, 2011

(54) IGNITION COIL AND METHOD FOR MANUFACTURING THE SAME

(75) Inventor: Junichi Wada, Chita-gun (JP)

(73) Assignee: Denso Corporation, Kariya (JP)

( * ) Notice: Subject to any disclaimer, the term of this patent is extended or adjusted under 35 U.S.C. 154(b) by 126 days.

(21) Appl. No.: 12/257,418

(22) Filed: Oct. 24, 2008

(65) Prior Publication Data

US 2009/0108972 A1 Apr. 30, 2009

(30) Foreign Application Priority Data

Oct. 26, 2007 (JP) ..... 2007-279363

(51) Int. Cl.

| | |
|---|---|
| ***H01F 27/02*** | (2006.01) |
| ***H01F 27/04*** | (2006.01) |
| ***H01F 27/29*** | (2006.01) |
| ***H01F 38/12*** | (2006.01) |
| ***H01F 7/06*** | (2006.01) |
| ***F02P 3/02*** | (2006.01) |

(52) U.S. Cl. ..... 336/90; 336/92; 336/94; 336/96; 336/107; 336/192; 123/634; 123/635; 29/602.1

(58) Field of Classification Search ..... 336/90, 336/92, 94, 96, 107, 192; 123/634–635; 29/602.1

See application file for complete search history.

(56) References Cited

U.S. PATENT DOCUMENTS

| | | | | |
|---|---|---|---|---|
| 5,295,861 | A * | 3/1994 | Peretick et al. | 439/527 |
| 5,349,320 | A * | 9/1994 | Suzuki et al. | 336/92 |
| 6,308,696 | B1 * | 10/2001 | Kondo et al. | 123/634 |
| 7,084,597 | B2 | 8/2006 | Nakai et al. | |
| 7,221,116 | B2 | 5/2007 | Nakai et al. | |
| 2005/0134416 | A1 * | 6/2005 | Maekawa et al. | 336/92 |
| 2006/0197489 | A1 | 9/2006 | Nakai et al. | |
| 2007/0182353 | A1 | 8/2007 | Kamio et al. | |

FOREIGN PATENT DOCUMENTS

| | | |
|---|---|---|
| DE | 103 07 458 | 9/2003 |
| JP | 2003-243236 | 8/2003 |

OTHER PUBLICATIONS

English translation of DE 10307458.*

* cited by examiner

*Primary Examiner* — Elvin G Enad
*Assistant Examiner* — Tszfung Chan
(74) *Attorney, Agent, or Firm* — Nixon & Vanderhye PC

(57) ABSTRACT

An ignition coil includes a coil body, a primary resin molded body, and a secondary resin molded body. The coil body has a primary coil and a secondary coil. The primary resin molded body has the coil body therein in a fixed relation, and the primary resin molded body has a plurality of exposed side portions that hold the coil body therebetween. The secondary resin molded body is molded to have the coil body and the primary resin molded body embedded therein. The secondary resin molded body is configured to allow the plurality of exposed side portions of the primary resin molded body to be exposed to an exterior of the secondary resin molded body.

9 Claims, 10 Drawing Sheets

IGNITION COIL AND METHOD FOR MANUFACTURING THE SAME

CROSS REFERENCE TO RELATED APPLICATION

This application is based on and incorporates herein by reference Japanese Patent Application No. 2007-279363 filed on Oct. 26, 2007.

BACKGROUND OF THE INVENTION

1. Field of the Invention

The present invention relates to an ignition coil that applies voltage to an ignition plug for an internal combustion engine, and relates to a manufacturing method for manufacturing the above ignition coil.

2. Description of Related Art

A conventional method for molding a resin molded body having a coil body embedded therein during the manufacture of an ignition coil has been known (see, for example, JP-A-2003-243236). Specifically, in the above molding method, a coil body, which has at least a primary coil and a secondary coil, is placed in a cavity of a die, and then a resin material, which is in a liquid or melted condition, is introduced into the cavity such that the resin material is cured to be hardened.

When the resin molded body of JP-A-2003-243236 having the coil body embedded therein is molded, the resin material is introduced into the cavity by a sufficient pressure such that the resin material is uniformly filed into an entirety of the cavity in a short time. Thus, in order to improve the productivity, it is important to place the coil body at a position in the cavity for limiting the displacement of the coil body due to the pressure during the introduction of the resin material.

In the above, the coil body of the ignition coil of JP-A-2003-243236 is not provided with a positioning portion that is configured to position the coil body in the cavity. Accordingly, in the manufacture of the above ignition coil of JP-A-2003-243236 having the coil body, in which a center core wounded with a primary coil is exposed to an exterior of the resin molded body, the center core is assumed to be held between dies for positioning the coil body in the cavity. However, in the above ignition coil, the center core made of a magnetic material, which core is exposed to the exterior of the resin molded body, may rust after the molding, and thereby performance degradation of the ignition coil may be caused. Therefore, there has been needed improvement.

SUMMARY OF THE INVENTION

The present invention is made in view of the above disadvantages. Thus, it is an objective of the present invention to address at least one of the above disadvantages.

To achieve the objective of the present invention, there is provided an ignition coil includes a coil body, a primary resin molded body, and a secondary resin molded body. The coil body has a primary coil and a secondary coil. The primary resin molded body has the coil body therein in a fixed relation, and the primary resin molded body has a plurality of exposed side portions that hold the coil body therebetween. The secondary resin molded body is molded to have the coil body and the primary resin molded body embedded therein. The secondary resin molded body is configured to allow the plurality of exposed side portions of the primary resin molded body to be exposed to an exterior of the secondary resin molded body.

To achieve the objective of the present invention, there is also provided a method for manufacturing the above ignition coil. In the method, a die assembly, in a cavity of which the primary resin molded body is placed, is closed such that the die assembly holds the plurality of exposed side portions, which holds the coil body of the primary resin molded body therebetween. A resin material is introduced into the cavity of the die assembly to mold the secondary resin molded body.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

Multiple embodiments of the present invention will be described with reference to accompanying drawings. It should be noted that similar components of an ignition coil of one embodiment, which are similar to components of the other ignition coils of the other embodiments, will be indicated by the same numerals, and the explanation thereof will be omitted.

First Embodiment

Figure 1:
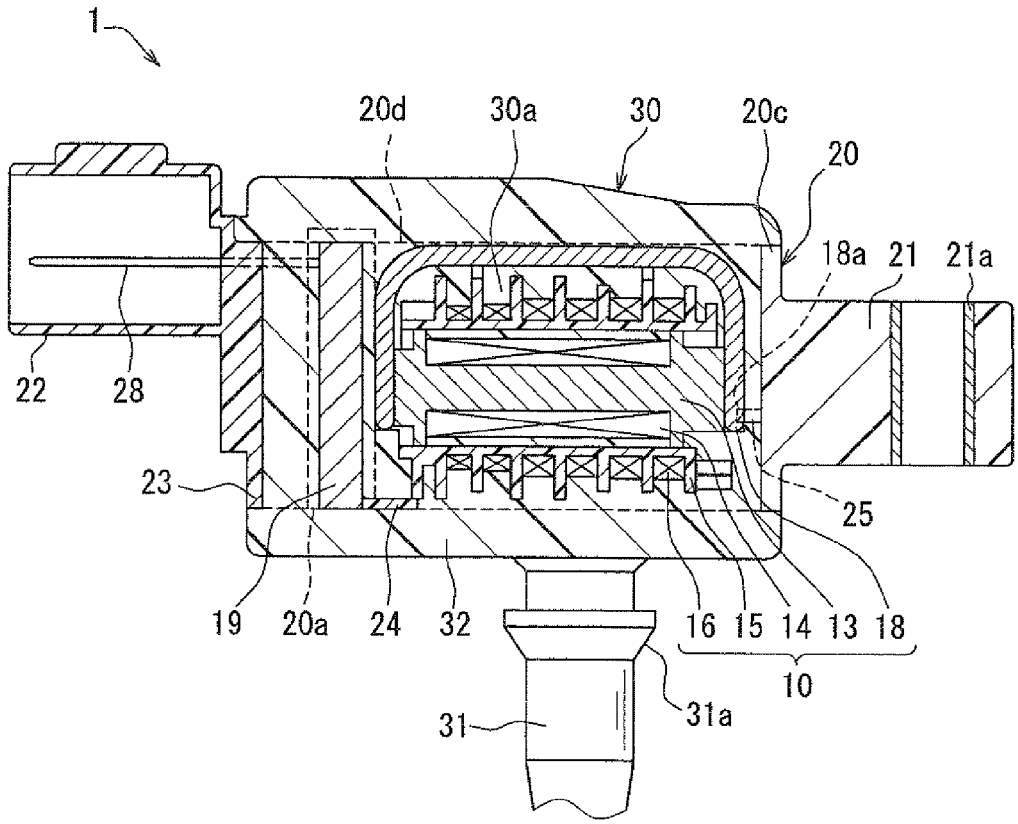
FIG. 1 is a cross-sectional view illustrating an ignition coil according to the first embodiment of the present invention.

As shown in FIG. 1, an ignition coil 1 of the first embodiment of the present invention includes a coil body 10 that integrally has a center core 13, a secondary spool 15, an outer peripheral core 18, a primary coil 14, and a secondary coil 16.

The center core 13 is made by, for example, pressure molding the magnetic powder, and has a generally column shape. The primary coil 14 having a hollow cylindrical shape is wound around a radially outer surface of the center core 13.

The primary coil 14 includes a primary conductor wire of, for example, 0.3 to 0.8 mm in diameter, which wire is wound number of turns of 100 to 230. The primary conductor wire has a leading end and a trailing end that are electrically connected with an igniter 19 provided to the ignition coil 1. It should be noted that although the primary conductor wire may employ an enamel coated wire, the primary conductor wire is not limited to the above wire provided that the adjacent primary conductor wires are electrically insulated from each other. Also, the center core 13 may be alternatively formed by arranging magnetic plates, such as a silicon steel plate, onto one another, instead of being formed by pressure molding. In the above alternative case, the primary coil 14 is not directly wound around the center core 13, however, the primary coil 14 may be alternatively wound around the center core 13 via a primary spool.

The secondary spool 15 is made of a resin material, and has a generally tubular shape. The secondary spool 15 is fixedly fitted with the center core 13 on a radially outer side of the center core 13 and the primary coil 14, and is coaxial with the center core 13 and the primary coil 14. The secondary coil 16 having a hollow cylindrical shape is wound around a radially outer surface of the secondary spool 15. The secondary coil 16 has a secondary conductor wire of, for example, 40 to 50 μm in diameter, which wire is wound number of turns of 10000 to 20000. The secondary conductor wire has a leading end that is electrically connected with the igniter 19. In contrast, the secondary conductor wire has a trailing end that is electrically connected with a high-voltage terminal (not shown) provided to the ignition coil 1. It should be noted that the secondary coil 16, which has larger number of turns than the primary coil 14, and which thereby generates substantially high voltage, may be, for example, slantly wound in order to limit the electric insulation breakdown of the secondary conductor wire caused by the voltage of the secondary conductor wire.

The outer peripheral core 18 is made of a magnetic plate, such as a pure iron, and has a U-shape form. The outer peripheral core 18 is fixed to an outer surface of the secondary spool 15, and the center core 13 is fixed to an inner surface of the secondary spool 15. As a result, the outer peripheral core 18 supports the primary coil 14, the secondary spool 15, and the secondary coil 16. In the above, the outer surface of the outer peripheral core 18 is provided with a fitting recess 18*a*, which will be described later. It should be noted that the outer peripheral core 18 may be also alternatively formed by arranging magnetic plates, such as a silicon steel plate, onto one another similar to the center core 13.

Figure 2:
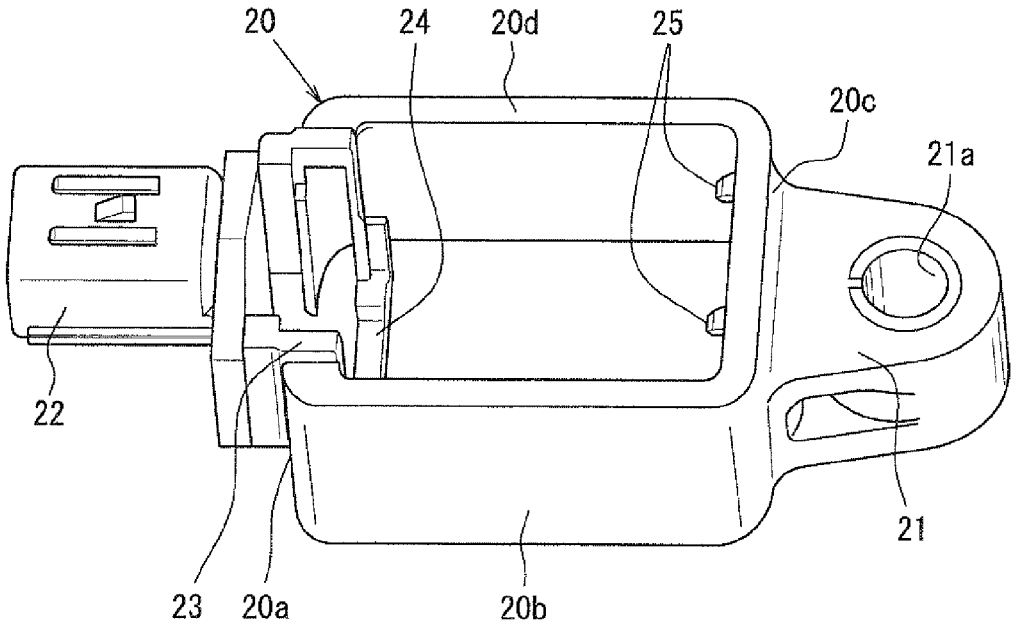
FIG. 2 is a perspective view illustrating a primary resin molded body of the ignition coil of the first embodiment of the present invention.

In the ignition coil 1, the coil body 10 is fixedly fitted inside a primary resin molded body (frame) 20, which is molded of a hard resin material, such as PBT, to have a frame shape. As shown in FIG. 2, the primary resin molded body 20 includes four side wall portions 20*a*, 20*b*, 20*c*, 20*d*, an igniter receiving portion 23, a connector portion 22, and a fixation portion 21. The side portions 20*a*, 20*b*, 20*c*, 20*d* configure a rectangular frame. The igniter receiving portion 23 projects from the side portion 20*a*. The connector portion 22 further projects from the igniter receiving portion 23, and the fixation portion 21 projects from the side portion 20*c*.

In the primary resin molded body 20 shown in FIGS. 1, 2, the side portion 20*a* (covered side portion) and the side portion 20*c* (third exposed side portion) are arranged to oppose to each other with the coil body 10 disposed between the side portion 20*a* and the side portion 20*c*. Also, the side portion 20*b* (first exposed side portion) and the side portion 20*d* (second exposed side portion) are arranged to oppose to each other with the coil body 10 disposed between the side portion 20*b* and the side portion 20*d*. In other words, the side portion 20*a* is provided on a side of the coil body 10 opposite to the side portion 20*c*, and the side portion 20*b* is provided on a side of the coil body 10 opposite to the side portion 20*d*. The side portion 20*c* has an inner surface, which is provided with two fitting protrusions 25, and the protrusions 25 are fitted with the fitting recess 18*a* of the outer peripheral core 18. Also, a plate suspension portion 24 is provided between the side portion 20*b* and the side portion 20*d* such that the suspension portion 24 bridges the side portions 20*b*, 20*d*. The suspension portion 24 supports the coil body 10 received in the primary resin molded body 20.

The igniter receiving portion 23 projects externally from the side portion 20*a* and is fixedly fitted with the igniter 19. The connector portion 22, which projects from the igniter receiving portion 23 in a direction away from the side portion 20*a*, includes a terminal 28 embedded therein, which terminal 28 is configured to electrically connect the coil body 10 with an external power source (not shown) via the igniter 19.

The fixation portion 21 externally projects from the side portion 20*c* in a direction away from the side portion 20*a* and is fixed with a tubular metal bush 21*a*. The metal bush 21*a* is in threaded engagement with a bolt (not shown) that fixes the ignition coil 1 to the internal combustion engine. In the above, specifically, the fixation portion 21 of the present embodiment projects from an inner side portion of an outer surface of the side portion 20*c*, which outer surface outwardly faces in a longitudinal direction of the center core 13. More specifically, the inner side portion of the outer surface is located radially inward relative to a outer peripheral edge of the outer surface of the side portion 20*c*.

Figure 3:
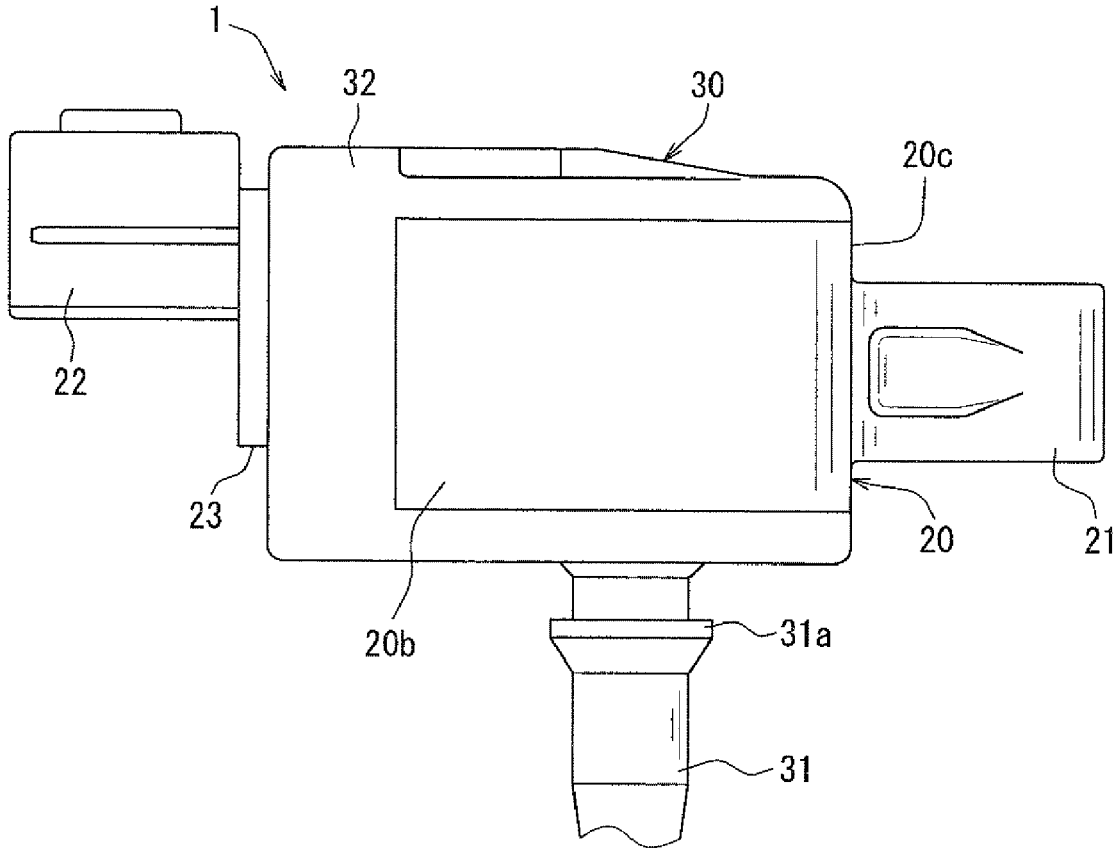
FIG. 3 is a front view illustrating the ignition coil of the first embodiment of the present invention.

As shown in FIGS. 1, 3, the primary resin molded body 20 is embedded in a main body portion 32 of a secondary resin molded body (casing) 30 together with the coil body 10. The secondary resin molded body 30 is molded of an electrically insulating resin material 30*a*, such as an epoxy resin, and includes the main body portion 32 having a square column shape. Specifically, in the present embodiment, the side portions 20*b*, 20*d*, between which the coil body 10 is provided, and the side portion 20*c*, which provides connection between the side portions 20*b*, 20*d*, are exposed to an exterior out of an outer surface of the main body portion 32 of the secondary resin molded body 30. Also, the side portion 20*a* is covered with the main body portion 32. In other words, the side portion 20*a* corresponding to a covered side portion. Also, in the present embodiment, the fixation portion 21 outwardly projects from the side portion 20*c* toward an exterior of the main body portion 32 of the secondary resin molded body 30 such that the fixation portion 21 is exposed to the outside. Also, the connector portion 22 and the igniter receiving portion 23 are configured to be exposed to the outside of the main body portion 32. It should be noted that as shown in FIG. 1 the resin material 30*a* that forms the secondary resin molded body 30 is sufficiently filled into corners of the coil body 10 embedded in the primary resin molded body 20, and thereby the electrical insulation of the secondary coil 16, which generates substantially high voltage, is achieved.

The secondary resin molded body 30 has a high voltage tower portion 31, which projects from the main body portion 32, and which has a cylindrical shape. A high-voltage terminal is embedded in the high voltage tower portion 31 and is connected with the secondary coil 16. The high voltage tower portion 31 has a radially outer surface that is provided with an annular engaging portion 31*a*. The engaging portion 31*a* is configured to be engaged with an inclusion member (not shown) that encapsulates a conductive member (not shown). In the above, the conductive member of the inclusion member is configured to electrically connect an ignition plug (not shown) with the high-voltage terminal in the ignition coil 1.

In the above ignition coil 1, signals from a control unit (not shown) or a power source are supplied through the terminal 28 of the connector portion 22. When the electric current that flows through the primary coil 14 is stopped by the igniter 19, mutual induction by the primary and secondary coils 14, 16, generates high voltage of, for example, 30 to 35 kV, in the secondary coil 16. The high voltage generated in the secondary coil 16 as above is introduced to the ignition plug through the high-voltage terminal in the high voltage tower portion 31 and through the conductive member in the inclusion member such that spark discharge is generated at a tip end of the ignition plug.

(Manufacturing Method of Ignition Coil)

Figure 4:
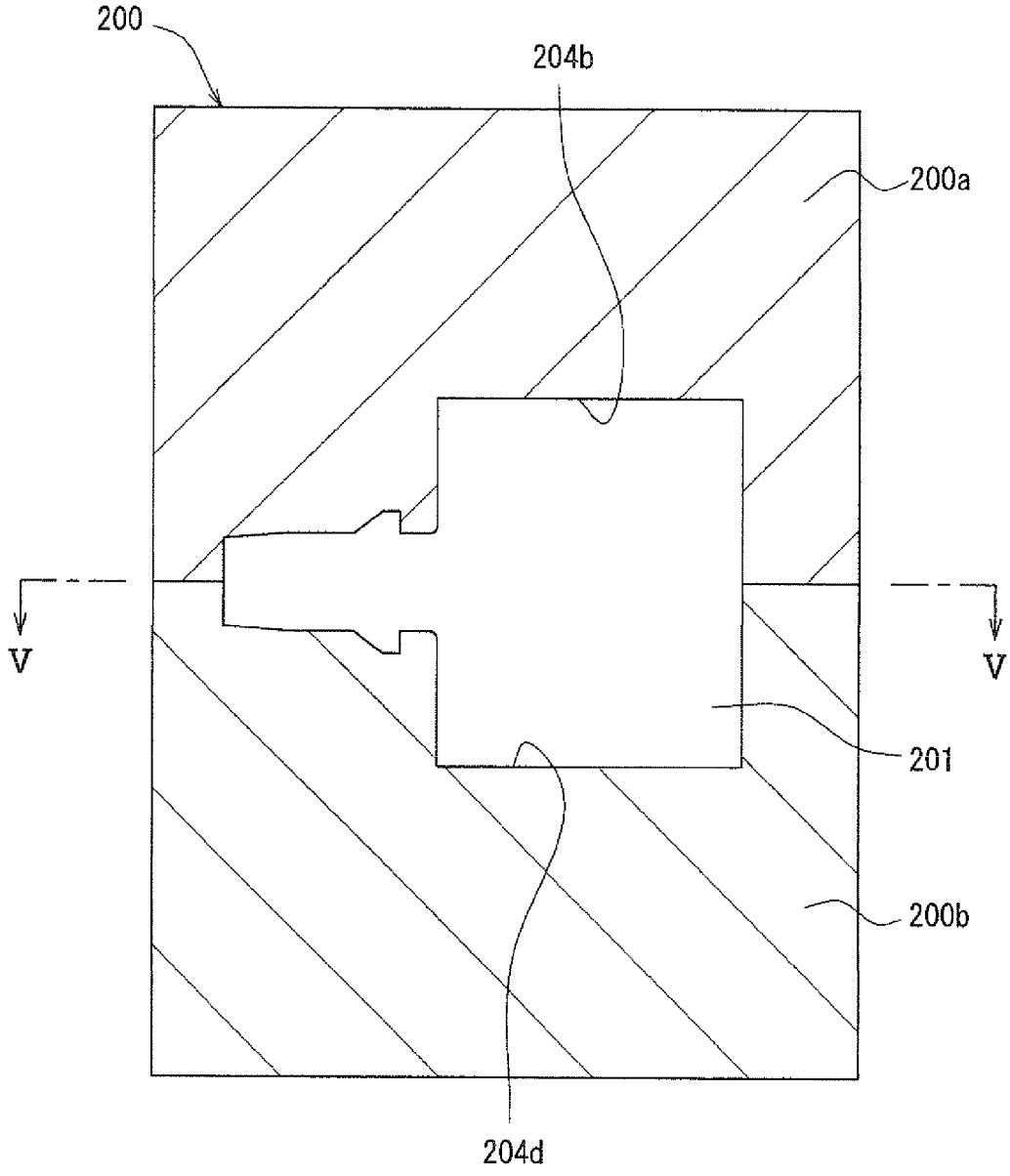
FIG. 4 is a schematic cross-sectional view illustrating a die assembly used in a method for manufacturing the ignition coil of the first embodiment of the present invention.
Figure 5:
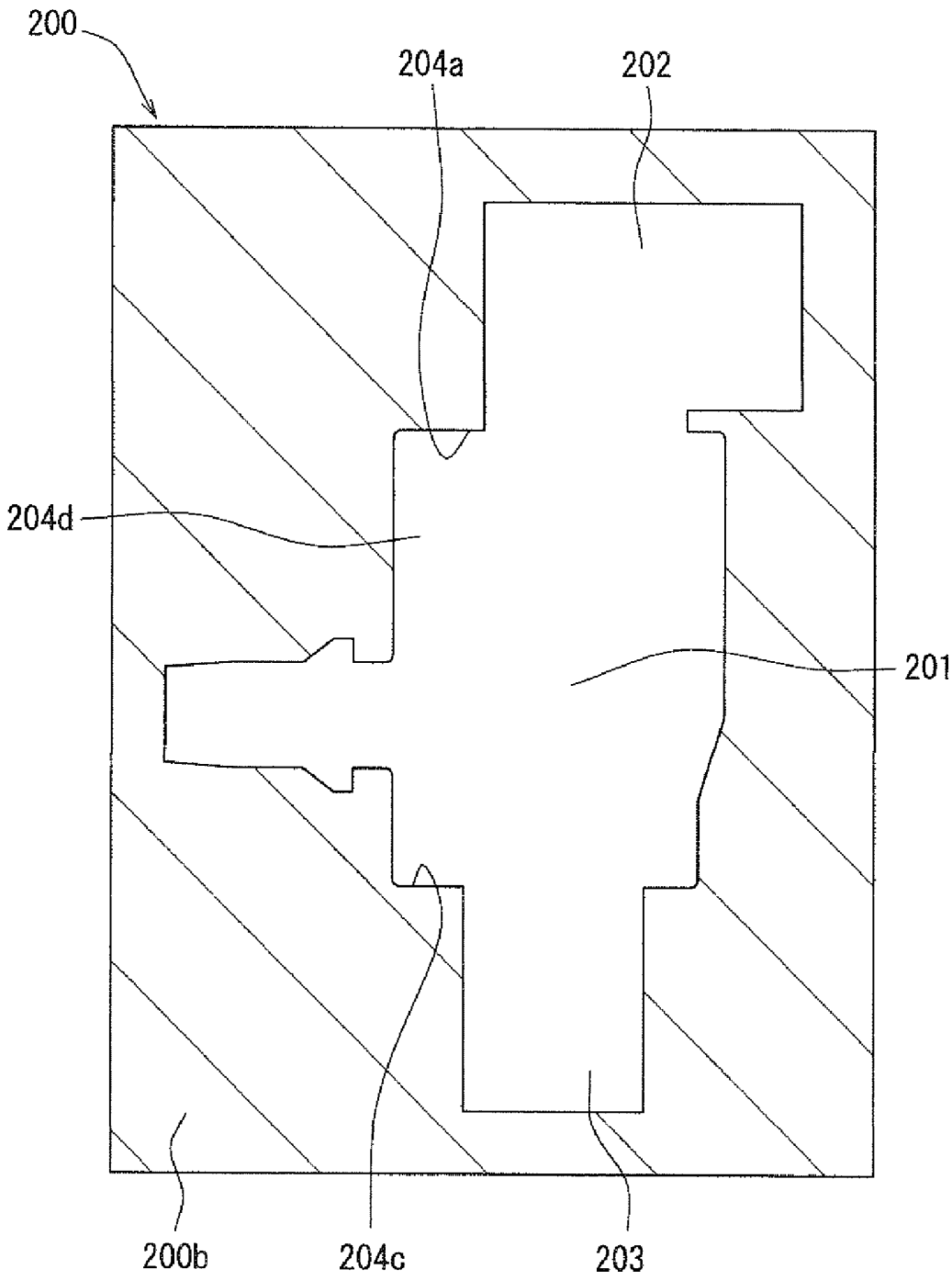
FIG. 5 is a schematic cross-sectional view of a die taken along line V-V in FIG. 4.

A manufacturing method for manufacturing the ignition coil 1 of the present embodiment will be described. The manufacturing method employs a die assembly 200 having a movable die 200*a* and a stationary die 200*b* as shown in FIGS. 4, 5. The die assembly 200 includes a cavity 201 and releasing spaces 202, 203. The cavity 201 is configured to mold the secondary resin molded body 30, and the releasing spaces 202, 203 are configured to receive the connector portion 22 and the fixation portion 21 of the primary resin molded body 20, respectively, such that the connector portion 22 and the fixation portion 21 extend from the cavity 201 when the primary resin molded body 20 is placed at a position in the cavity 201. In the above, specifically, the die assembly 200 of the present embodiment has four inner surfaces 204*a*, 204*b*, 204*c*, 204*d* for forming the main body portion 32 of the secondary resin molded body 30. The releasing space 202 for the connector portion 22 opens at the inner surface 204*a*, and the releasing space 203 for the fixation portion 21 opens at the inner surface 204*c*, which opposes to the inner surface 204*a*.

Figure 6:
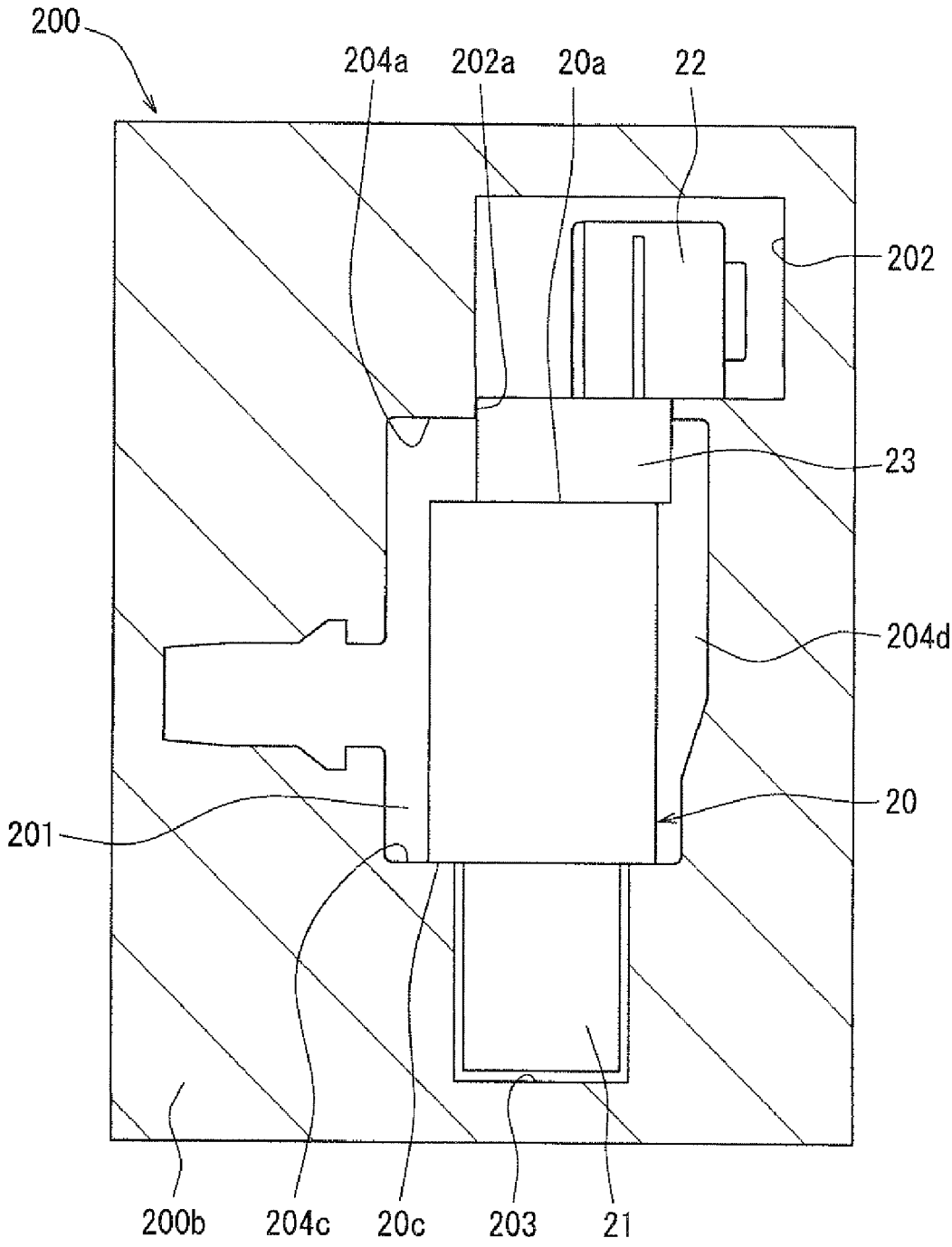
FIG. 6 is a schematic diagram used for explaining the method for manufacturing the ignition coil of the first embodiment of the present invention.

In the manufacturing method of the ignition coil 1 by using the above die assembly 200, firstly, in a die closing step, the primary resin molded body 20, to which the coil body 10 and the igniter 19 are fixed, is placed in the cavity 201 of the stationary die 200*b* as shown in FIG. 6 such that the side portion 20*d* of the molded body 20 is brought into contact with the inner surface 204*d* of the stationary die 200*b*. Then, by displacing the movable die 200*a* closer toward the stationary die 200*b* in order to close the die assembly 200, the inner surface 204*b* of the movable die 200*a* is brought into contact with the side portion 20*b* of the primary resin molded body 20.

As a result, the side portions 20*b*, 20*d*, between which the coil body 10 is provided in the primary resin molded body 20, are provided between the inner surfaces 204*b*, 204*d* of the die assembly 200. Also, the fixation portion 21 is received in the releasing space 203 with a clearance between an outer peripheral face of the fixation portion 21 and an inner peripheral face of the releasing space 203. The side portion 20*c* of the primary resin molded body 20, from which portion 20*c* the fixation portion 21 projects, contacts the inner surface 204*c* of the die assembly 200. As a result, the releasing space 203 is separated from the cavity 201. Also, the connector portion 22 is received in the releasing space 202 with a clearance between an outer face of the connector portion 22 and an inner face of the releasing space 202. The igniter receiving portion 23, which is provided on a side of the connector portion 22 toward the side portion 20*a*, is fitted with an opening 202*a* of the releasing space 202, which opening 202*a* is formed at the inner surface 204*a* of the die assembly 200. Thus, the releasing space 202 is separated from the cavity 201. According to the above configuration, in a case of molding the secondary resin molded body 30, a segment of the side portion, which segment is the radially outer area of the side portion relative to the fixation portion 21, is brought into contact with the die assembly for the positioning of the primary resin molded body 20.

Next, in a molding step, the resin material 30*a*, for example, epoxy resin, in a liquid or melted condition is introduced into the cavity 201 under a predetermined pressure (introducing pressure) through a gate (not shown), which is provided as a flow channel for communication with the cavity 201. In the above case, because the side portions 20*b*, 20*d* are provided between the inner surfaces 204*b*, 204*d* of the die assembly 200, the primary resin molded body 20 is limited from being displaced in an opposing direction (lateral direction), in which the side portions 20*b*, 20*d* are arranged to oppose to each other. Also, because the side portion 20*c* is pressed against the inner surface 204*c* of the die assembly 200 due to the above introducing pressure applied to the side portion 20*a*, which is spaced apart from the inner surface 204*a* of the die assembly 200, the primary resin molded body 20 is limited from being displaced in another opposing direction (longitudinal direction), in which the side portions 20*c*, 20*a* are arranged to oppose to each other. Furthermore, the resin material 30*a* is limited from entering into the releasing spaces 203, 202 because of the pressing of the side portion 20*c* against the inner surface 204*c*, and because of the fitting of the igniter receiving portion 23 into the opening 202*a* of the inner surface 204*a*. It should be noted that the above introducing pressure, under which the resin material 30*a* is introduced into the cavity 201 in the molding step, is determined such that the resin material 30*a* in the cavity 201 in a liquid or melted condition is limited from forming air voids therein, and such that the resin material 30*a* is sufficiently filled into the corners of the coil body 10 in the primary resin molded body 20.

Figure 7:
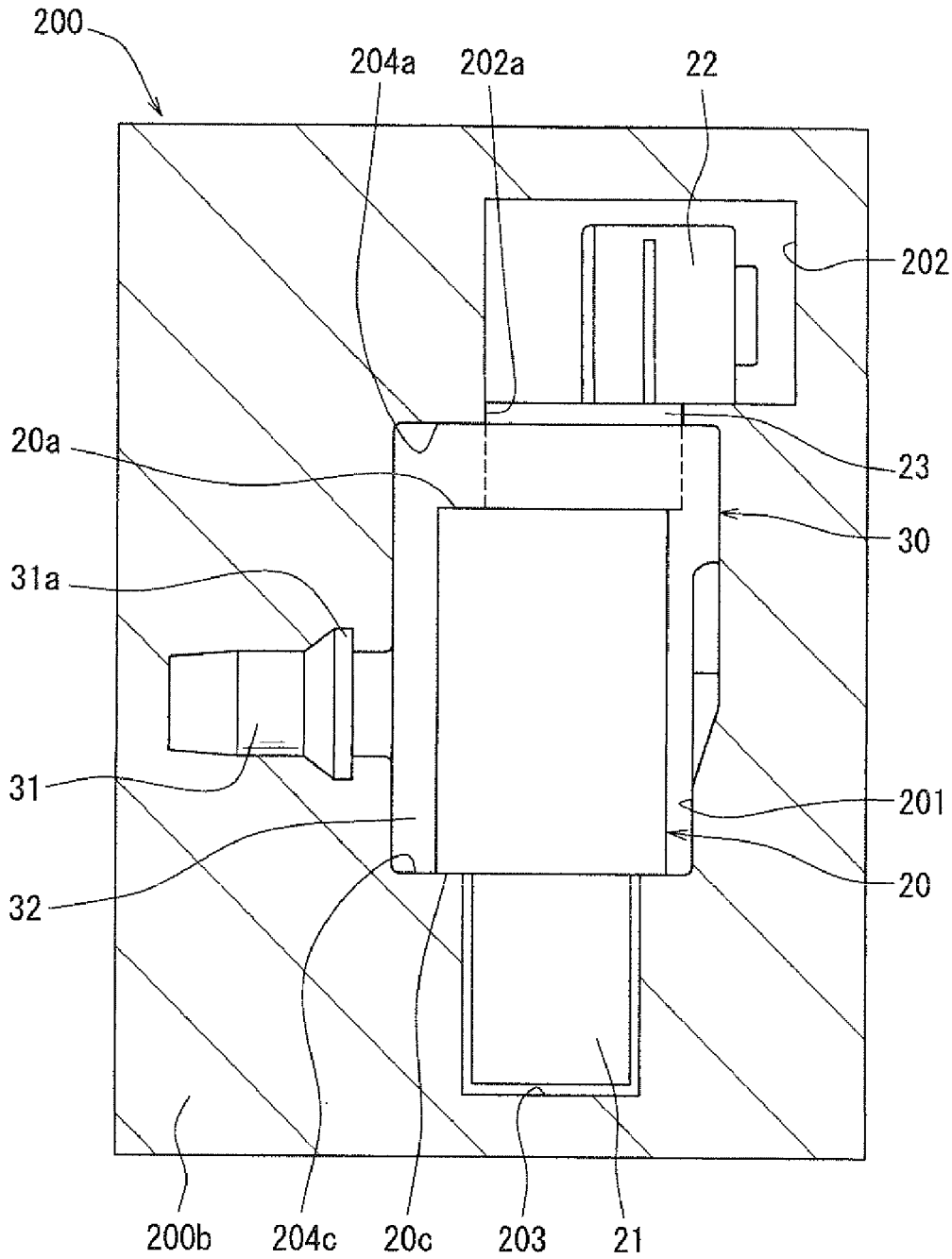
FIG. 7 is another schematic diagram used for explaining the method for manufacturing the ignition coil of the first embodiment of the present invention.
Figure 8:
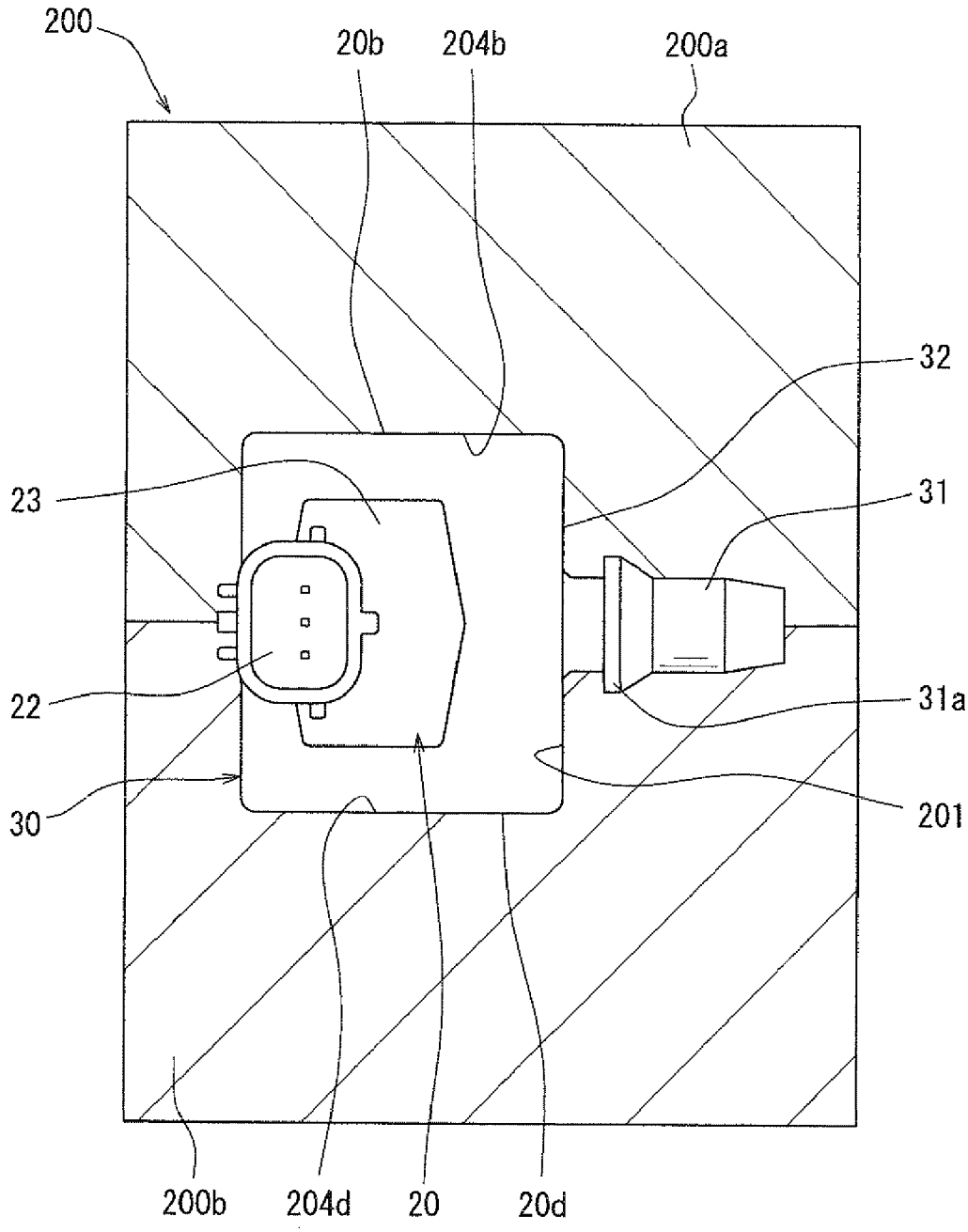
FIG. 8 is still another schematic diagram used for explaining the method for manufacturing the ignition coil of the first embodiment of the present invention.

As above, after the cavity 201 has been filled with the resin material 30*a*, the die assembly 200 is heated or cooled to cure the resin material 30*a* in the molding step. The above process is able to mold the secondary resin molded body 30, in which the side portions 20*b*, 20*d*, 20*c*, the fixation portion 21, the connector portion 22, and the igniter receiving portion 23 of the primary resin molded body 20 are exposed to the exterior out of the main body portion 32 as shown in FIGS. 7, 8. It should be noted that after the above, the inclusion member encapsulating the conductive member is engaged with the engaging portion 31*a* of the high voltage tower portion 31 of the secondary resin molded body 30 such that the ignition coil 1 is completed.

According to the above first embodiment, when the resin material 30*a* is introduced into the die assembly 200 in the molding step executed after the die closing step, the primary resin molded body 20 is accurately positioned by using the die assembly 200 to support the primary resin molded body 20, and the coil body 10 and the igniter 19 of the primary resin molded body 20 are also positioned accurately. Due to the above, manufacturing errors are limited, and thereby the productivity is more improved. Also, although the primary resin molded body 20 is exposed to the exterior out of the secondary resin molded body 30 obtained in the molding step, the coil body 10 is completely covered with the secondary resin molded body 30. As a result, the performance degradation, which may be otherwise caused in a conventional art, is limited in the present embodiment. Therefore, in the first embodiment, the productivity is improved, and also at the same time, the performance is effectively and sufficiently achieved.

Second Embodiment

The second embodiment of the present invention is a modification of the first embodiment.

Figure 9:
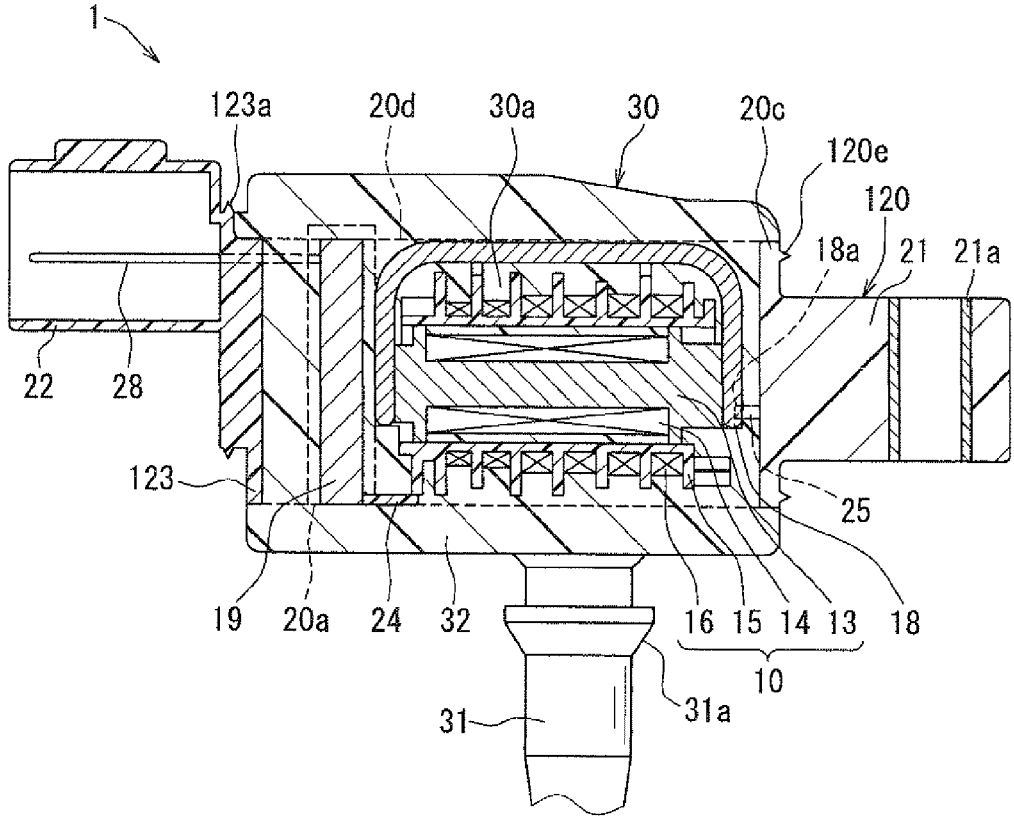
FIG. 9 is a cross-sectional view illustrating an ignition coil according to the second embodiment of the present invention.
Figure 10:
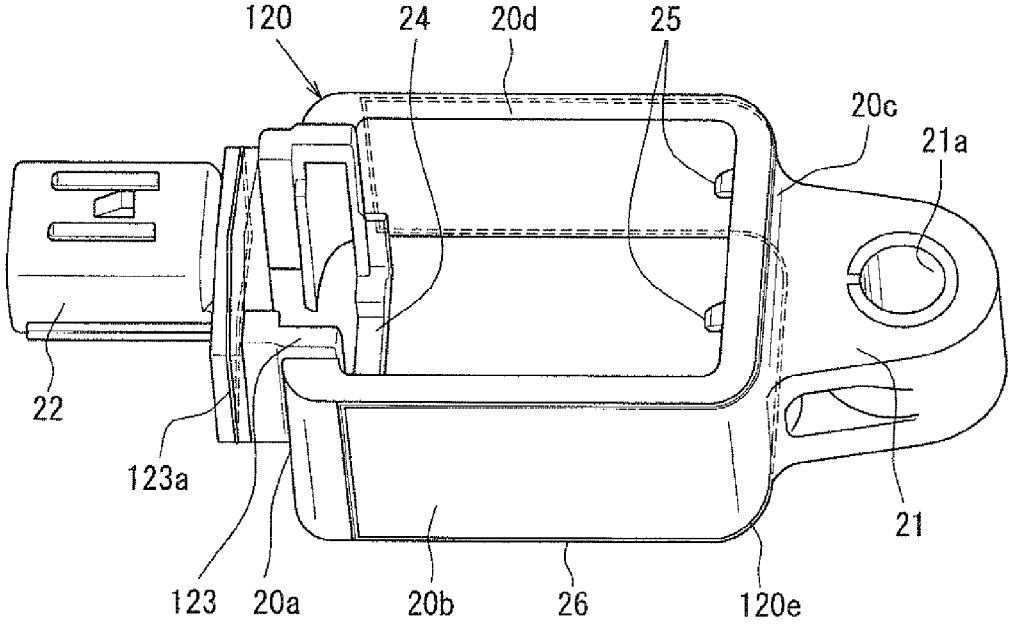
FIG. 10 is a perspective view illustrating a primary resin molded body of the ignition coil of the second embodiment of the present invention.

As shown in FIGS. 9, 10, a primary resin molded body 120 of the second embodiment, a contact ridge 120*e* is provided to extend across the side portions 20*b*, 20*c*, 20*d*, which are exposed to the exterior of the secondary resin molded body 30. Specifically, the contact ridge 120*e* projects from an outer surface of each of the side portions 20*b*, 20*c*, 20*d* toward the exterior of the secondary resin molded body 30, and has a generally triangular shape in a cross section. There is defined a first boundary between the side portion 20*b* and the side portion 20*c*. There is defined a second boundary between the side portion 20*c* and the side portion 20*d*. The contact ridge 120*e* of the present embodiment continuously extends along the outer peripheral edges of the side portions 20*b*, 20*c*, 20*d* except for the above first and second boundaries between the side portions 20*b*, 20*c*, 20*d* to have an annular shape. In other words, the contact ridge 120*e* is configured to have an annular shape that extends along a radially outer side of the fixation portion 21, which projects from the side portion 20*c*. In other words, the contact ridge 123*a* extends along the outer peripheral edge of a U-shaped configuration, which is made by generally orthogonally arranging the side portion 20*c* between end portions of the parallelly arranged side portions 20*b*, 20*d*.

Also, in the primary resin molded body 120 of the second embodiment, an igniter receiving portion 123, which is exposed to the exterior from the secondary resin molded body 30, is also provided with a contact ridge 123*a*. Specifically, the contact ridge 123*a* projects from a radially outer surface of the igniter receiving portion 123 of an exterior of the secondary resin molded body 30, and has a generally triangular shape in a cross section. Also, the contact ridge 123*a* of the present embodiment is configured to have an annular shape that continuously extends around the radially outer surface of the igniter receiving portion 123.

Figure 11:
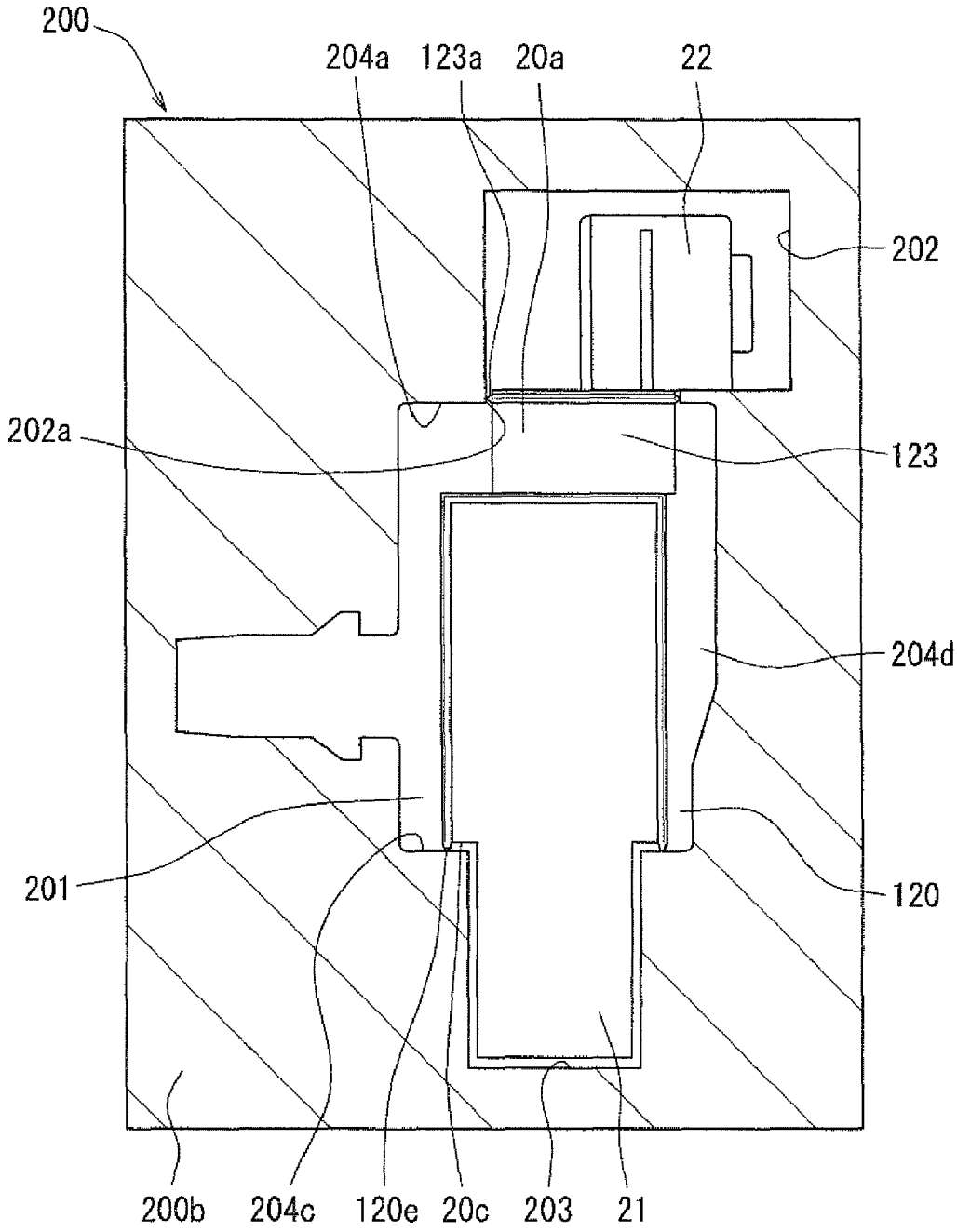
FIG. 11 is a schematic diagram for explaining a method for manufacturing the ignition coil of the second embodiment of the present invention.

In the above second embodiment, in the die closing step, the contact ridge 120*e*, which extends across the side portions 20*b*, 20*c*, 20*d* of the primary resin molded body 120 to extend around the fixation portion 21, contacts the inner surfaces 204*b*, 204*c*, 204*d* of the die assembly 200 as shown in FIG. 11. As a result, the contact pressure at the contact boundary surface becomes high. Thus, a gap between (a) the side portion 20*c*, from which the fixation portion 21 extends, and (b) the die assembly 200, and the other gaps between (a) the side portions 20*b*, 20*d* and (b) the die assembly 200 are substantially sealed in the molding step, and thereby degradation of the positioning accuracy caused by the entering of the resin material 30*a* into the above gaps is effectively limited.

Also, in addition to the sealing of the above gaps between (a) the side portion 20*c*, 20*b*, 20*d* and (b) the die assembly 200, because the contact ridge 123*a*, which is provided to the receiving portion 123, contacts the opening 202*a* of the releasing space 202 in the inner surface 204*a* under a high contact pressure, a gap between the igniter receiving portion 123 and the die assembly 200 is also sufficiently sealed. As a result, in the molding step, the entering of the resin material 30*a* into the releasing spaces 203, 202 is effectively limited.

Third Embodiment

The third embodiment of the present invention is a modification of the first embodiment.

In the primary resin molded body 20 of the first embodiment, if there are changes in a physical or positional relation between the side portions, from which the fixation portion 21 and the connector portion 22 project, respectively, there should be prepared different dies, each of which has the releasing spaces 202, 203 at positions correspondingly to the above changes in the physical relation. As a result, productivity may deteriorate due to the preparation of the different dies.

Figure 12:
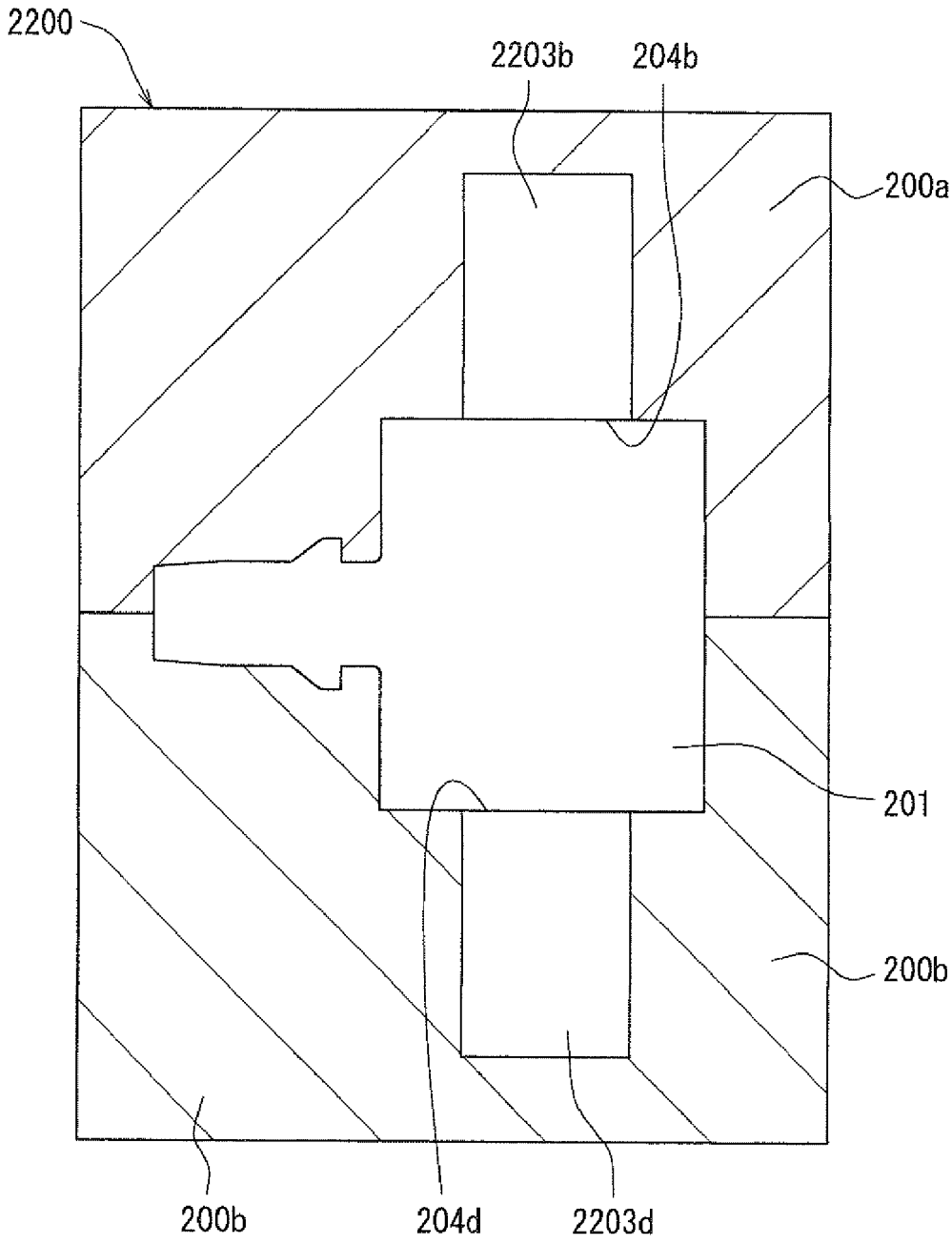
FIG. 12 is a schematic cross-sectional view illustrating a die assembly used in a method for manufacturing an ignition coil of the third embodiment of the present invention.

Thus, as shown in FIG. 12, a die assembly 2200 of the third embodiment includes releasing spaces 2203*b*, 2203*d* in addition to the releasing space 203 that opens at the inner surface 204*c*. Each of the releasing spaces 2203*b*, 2203*d* is configured to provide space for the fixation portion 21 of the primary resin molded body 20 in the die assembly 2200, and open at the inner surfaces 204*b*, 204*d*. It should be noted that in the present embodiment the releasing spaces 203, 2203*b*, 2203*d* may be connected with each other in a direction, in which the inner surfaces 204*b*, 204*c*, 204*d* are arranged in series. Also, the releasing spaces 203, 2203*b*, 2203*d* may be alternatively separate from each other in the direction.

In a die closing step of the above third embodiment, because the primary resin molded body 20 is held between the inner surfaces 204*b*, 204*d* in a state, where the side portions 20*b*, 20*d* of the primary resin molded body 20 contact the inner surfaces 204*b*, 204*d*, the releasing spaces 2203*b*, 2203*d* correspondingly formed on the inner surfaces 204*b*, 204*d* are separated from the cavity 201. As a result, even in a product, in which the fixation portion 21 projects from a radially inner side of the outer peripheral edge of the side portion 20*b* instead of projecting from the side portion 20*c*, by making the fixation portion 21 be received in the releasing space 2203*b* opening at the inner surface 204*b*, which the side portion 20*b* contacts, the entering of the resin material 30*a* into the releasing space 2203*b* is effectively limited in the molding step. Also similarly, even in a product, in which the fixation portion 21 projects from the radially inner side of the outer peripheral edge of the side portion 20*d*, by making the fixation portion 21 be received in the releasing space 2203*d* opening at the inner surface 204*d*, which the side portion 20*d* contacts, the entering of the resin material 30*a* into the releasing space 2203*d* is effectively limited in the molding step.

In the above third embodiment, even in any products, in which the fixation portion 21 projects from any one of the side portions 20*b*, 20*c*, 20*d*, because a common die assembly 2200, which is able to be shared by any projects, is employed for manufacturing, costs of production is effectively reduced.

As above, multiple embodiments of the present invention are explained. However, the interpretation of the present invention is not limited to the above embodiments, and the present invention is applicable to various embodiments provided that the embodiments are not deviating from the gist.

In the above embodiments, the outer peripheral edge of each of the side portions indicates an outer edge of the side portion along a plane, on which the side portion extends. Additional advantages and modifications will readily occur to those skilled in the art. The invention in its broader terms is therefore not limited to the specific details, representative apparatus, and illustrative examples shown and described.

What is claimed is:

1. An ignition coil comprising:

a coil body that has a primary coil and a secondary coil;

a primary resin molded frame that has the coil body disposed therein in a fixed relation, wherein the primary resin molded frame has a plurality of exposed side wall portions that hold the coil body therebetween; and a secondary resin molded casing that is molded to have the coil body and the primary resin molded frame partly embedded therein, wherein:

the secondary resin molded casing is configured so that at least a part of each of said exposed side wall portions of the primary resin molded frame is uncovered and exposed to an outside of the secondary resin molded casing the plurality of exposed side wall portions of the primary resin molded frame includes a first exposed side wall portion and a second exposed side wall portion;

the coil body is held between the first exposed side wall portion and the second exposed side wall portion;

the primary resin molded frame includes a third exposed side wall portion that connects the first exposed side wall portion with the second exposed side wall portion;

the primary resin molded frame includes a covered side portion that is covered with the secondary resin molded casing; and the first to third exposed side wall portions and the covered side portion form a rectangular frame for receiving and supporting the coil body.

2. The ignition coil according to claim 1, wherein:

the primary resin molded frame includes a fixation portion that projects from an inner side of an outer peripheral edge of one of the plurality of exposed side wall portions toward the exterior of the secondary resin molded casing; and the fixation portion is adapted to be fixed to an internal combustion engine.

3. The ignition coil according to claim 2, wherein:

the primary resin molded frame includes a contact ridge that is provided along an outer peripheral edge of one of the plurality of exposed side wall portions such that the contact ridge projects from the one of the plurality of exposed side wall portions toward the exterior of the secondary resin molded casing.

4. The ignition coil according to claim 2, wherein:

the fixation portion projects from at least one of the first to third exposed side wall portions.

5. The ignition coil according to claim 1, wherein:

the primary resin molded frame includes a fixation portion that projects from an inner side of an outer peripheral edge of one of the first to third exposed side wall portions toward the exterior of the secondary resin molded casing; and the fixation portion is adapted to be fixed to an internal combustion engine.

6. The ignition coil according to claim 5, wherein:

the primary resin molded frame includes a contact ridge that is provided along an outer peripheral edge of one of the first to third exposed side wall portions such that the contact ridge projects from the one of the first to third exposed side wall portions toward the exterior of the secondary resin molded casing.

7. A method for manufacturing the ignition coil according to claim 1, the method comprising:

closing a die assembly, in a cavity of which the primary resin molded frame is placed, such that the die assembly directly contacts and holds the plurality of exposed side wall portions which hold the coil body of the primary resin molded frame therebetween; and introducing a resin material into the cavity of the die assembly to mold the secondary resin molded casing.

8. The manufacturing method according to claim 7 for manufacturing the ignition coil, in which the primary resin molded frame has a fixation portion that projects from an inner side of an outer peripheral edge of one of the plurality of exposed side wall portions toward the exterior of the secondary resin molded casing, and in which the fixation portion is adapted to be fixed to an internal combustion engine, wherein:

the closing of the die assembly includes bringing the one of the plurality of exposed side wall portions, from which one the fixation portion projects, into contact with a corresponding inner surface of the die assembly such that the fixation portion is inserted into a releasing space, which opens to the corresponding inner surface of the die assembly.

9. The manufacturing method according to claim 7 for manufacturing the ignition coil, in which the primary resin molded frame has a covered side portion that is covered with the secondary resin molded casing, and in which the primary resin molded frame has a connector portion that further projects toward the exterior of the secondary resin molded casing relative to the covered side portion for electrically connecting the coil body with an external power source, wherein:

the closing of the die assembly includes inserting the connector portion into a releasing space, which has an opening open to a corresponding inner surface of the die assembly, such that a part of the primary resin molded frame is fitted with the opening of the releasing space; and the part is positioned on a side of the connector portion toward the covered side portion.

* * * * *